US005439709A

United States Patent [19]

Becker et al.

[11] Patent Number: 5,439,709

[45] Date of Patent: Aug. 8, 1995

[54] FATTY ACID METHYL ESTERS IN LUBRICANTS FOR CARD SPINNING

[75] Inventors: Wolfgang Becker, Moenchengladbach; Raymond Mathis, Duesseldorf; Ulrich Eicken, Korschenbroich; Karin Robrahn, Mettmann; Silvia Stapper-Druyen, Moenchengladbach, all of Germany

[73] Assignee: Henkel Kommanditgesellschaft auf Aktien, Duesseldorf, Germany

[21] Appl. No.: 142,451

[22] PCT Filed: May 20, 1992

[86] PCT No.: PCT/EP92/01121

§ 371 Date: Jan. 26, 1994

§ 102(e) Date: Jan. 26, 1994

[87] PCT Pub. No.: WO92/21809

PCT Pub. Date: May 20, 1992

[30] Foreign Application Priority Data

May 29, 1991 [DE] Germany ..... 41 17 670.7
Jan. 25, 1992 [DE] Germany ..... 42 01 978.8

[51] Int. Cl.[6] ..... B05D 5/00; D06M 13/184

[52] U.S. Cl. ..... 427/389.9; 8/115.51; 8/115.6; 252/8.6; 252/8.8; 252/8.9; 427/394; 427/421

[58] Field of Search ..... 252/8.6, 8.8, 8.9, 50, 252/51, 51.5 R, 51.5 A, 52 R, 56 R, 49.3; 427/389.9, 394, 421; 8/115.51, 115.6

[56] References Cited

U.S. PATENT DOCUMENTS

| | | | |
|---|---|---|---|
| 3,926,816 | 12/1975 | Cohen et al. | 252/8.6 |
| 4,110,227 | 8/1978 | Newkirk et al. | 252/8.6 |
| 4,127,490 | 11/1978 | Newkirk et al. | 252/8.6 |
| 4,201,680 | 5/1980 | Waltenberger et al. | 252/8.6 |
| 5,282,871 | 2/1994 | Yamane et al. | 252/8.6 |

FOREIGN PATENT DOCUMENTS

| | | | |
|---|---|---|---|
| 1276531 | 12/1960 | France . | |
| 3924160 | 1/1991 | Germany . | |
| 3936975 | 1/1991 | Germany . | |
| 55-128074 | 10/1980 | Japan | 252/8.8 |
| 58-180678 | 10/1983 | Japan | 252/8.8 |
| 61-126675 | 11/1986 | Japan | 252/8.8 |
| 62-090372 | 4/1987 | Japan | 252/8.8 |
| 3-59172 | 3/1991 | Japan | 252/8.8 |
| 539333 | 9/1941 | United Kingdom | 252/8.8 |
| 571490 | 8/1945 | United Kingdom | 252/8.8 |
| 0680220 | 10/1952 | United Kingdom . | |
| 1055344 | 1/1967 | United Kingdom | 252/8.8 |
| 705036 | 12/1979 | U.S.S.R. | 252/8.8 |

OTHER PUBLICATIONS

Textil Praxis International, 1984 (8), pp. 748–758 [no month].

Vollmert, "Grundriss der makromolekularen Chemie", Band III, pp. 55–61, Karlsruhe 1982 [no month].

"Neue Aspekte des Avivierens in der Streichgarnspinnerei", von Dr. Veitenhansl et al. in Textilpraxis international, Aug. 1984, pp. 748–756.

*Primary Examiner*—Anthony Green

*Attorney, Agent, or Firm*—Ernest G. Szoke; Wayne C. Jaeschke; Real J. Grandmaison

[57] ABSTRACT

The invention relates to the use of $C_{8-22}$ fatty acid methyl esters in lubricants for card spinning, to a process for lubricating textile fibers for the production of carded yarns and to lubricants containing $C_{8-22}$ fatty acid methyl esters and (meth)acrylates having limiting viscosities below 400 ml $\cdot g^{-1}$, as measured in tetrahydrofuran at 20° C.

15 Claims, No Drawings

FATTY ACID METHYL ESTERS IN LUBRICANTS FOR CARD SPINNING

This invention relates to the use of $C_{8-22}$ fatty methyl esters as smoothing agents in lubricants for card spinning and to a process for lubricating textile fibers for the production of carded yarn. The invention also relates to lubricants containing $C_{8-22}$ fatty acid methyl esters and homopolymers and/or copolymers of esters of acrylic and/or methacrylic acid having limiting viscosities [eta] below 400 $ml \cdot g^{-1}$ in quantities of 0.05 to 10% by weight, based on lubricant.

Textile fibers which are processed to carded yarns are subjected to combing before spinning to parallelize the fibers and to establish a fiber structure. The textile fibers are subjected to very severe mechanical stressing during the combing process. Accordingly, the textile fibers are treated with a lubricant containing a smoothing agent before combing in order to avoid fiber damage attributible to high friction between fibers and metal surfaces (fiber/metal friction) and to obtain optimal friction between the individual fibers (fiber/fiber friction). Lubricants contain smoothing agents to avoid fiber damage, emulsifiers to enable them to be applied as emulsions and, optionally, other additives. In many cases, lubricants containing hydrocarbons as smoothing agents are used. Since these smoothing agents are not readily biodegradable, they are being replaced to an increasing extent by readily biodegradable smoothing agents for lubricants, for example by fatty acid esters (Textil Praxis International 1984 (8), 748–758).

In addition to ready biodegradability, the smoothing agent and lubricant must show good spreading power on the fibers. Although lubricants containing isobutyl stearate or 2-ethylhexyl stearate as smoothing agents are readily biodegradable, they do not spread satisfactorily on the fibers and, hence, do not provide for optimal fiber/fiber and fiber/metal friction in the production of carded yarn.

Accordingly, the problem addressed by the present invention was to develop a lubricant for card spinning which, in addition to ready biodegradability, would have excellent spreading power on the fibers.

DESCRIPTION OF THE INVENTION

It has been found that the requirements stated above for the lubricant to be developed can be satisfied by the use of $C_{8-22}$ fatty acid methyl esters as smoothing agents in lubricants.

Accordingly, the present invention relates to the use of one or more $C_{8-22}$ fatty acid methyl esters as smoothing agents in lubricants for card spinning.

The fatty acid methyl esters used in accordance with the invention are commercially available products which are produced by esterification of the free fatty acid by methods known per se or by transesterification of fatty acid triglycerides with methanol, generally in the presence of acidic catalysts. Fatty acid methyl esters which have been produced by transesterification of natural triglycerides, such as coconut oil, soybean oil, rapeseed oil, sunflower oil, palm oil and tallow, are preferred for the purposes of the invention. The methyl esters obtained may be used without further working up, after working up by distillation or even after hydrogenation of the unsaturated components. Accordingly, methyl esters of unsaturated and/or saturated fatty acids, preferably $C_{12-22}$ fatty acids, such as lauric acid, oleic acid, stearic acid, behenic acid, linoleic acid and/or linolenic acid, may be used.

The fatty acid methyl esters are preferably used in the card spinning lubricants in quantities of 50 to 95% by weight and more preferably in quantities of 60 to 90% by weight.

The lubricants according to the invention may contain emulsifiers, additives, such as corrosion inhibitors, antistatic agents, coupling agents, bactericides, antioxidants, pH regulators and viscosity enhancers, as further constituents.

Suitable emulsifiers are nonionic, anionic and cationic emulsifiers, for example partial esters of di- and/or triglycerol, such as triglycerol monooleate, alkoxylated, preferably ethoxylated and/or propoxylated fats, oils, $C_{8-22}$ fatty acids, $C_{8-22}$ fatty alcohols and/or $C_{8-22}$ fatty acid mono- and/or diethanolamides, such as optionally ethoxylated oleic acid mono- or diethanolamide, alkoxylated, preferably ethoxylated, $C_{8-22}$ fatty acids, of which the OH group is replaced by a $C_{1-4}$ alkoxy group, alkali metal and/or ammonium salts of $C_{8-22}$ alkyl sulfonates, alkali metal and/or ammonium salts of $C_{8-22}$ alkyl sulfosuccinates, such as sodium dioctyl sulfosuccinate, and/or amine oxides, such as dimethyl dodecyl amine oxide.

In principle, triglycerides, such as the relatively high-viscosity rapeseed oil, or polymeric compounds may be used to increase the viscosity of the lubricant. DE-PS 3 936 975 describes spooling oils which contain fatty alcohol polymethacrylates to prevent the spooling oil from spraying. DE-A-39 241 160 describes additives containing carboxyl-free homopolymers and/or copolymers of esters of acrylic and/or methacrylic acid having limiting viscosities of at least 300 and preferably 800 ml $g^{-1}$. By virtue of their high limiting viscosity, these additives are capable of improving the filament-drawing power and/or adhesion of oils and/or fats.

However, the object of the present invention was not to increase the filament drawing power and/or adhesion of lubricants containing the fatty acid methyl esters, but rather their viscosity. Accordingly, another problem addressed by the present invention was to provide lubricants based on fatty acid methyl esters having viscosities comparable with those based on mineral oil. This problem has been solved by the addition of homopolymers and/or copolymers of esters of acrylic and/or methacrylic acid having limiting viscosities [eta] below 400 $ml \cdot g^{-1}$ in quantities of 0.05 to 10% by weight, based on lubricant.

Accordingly, the present invention also relates to lubricants for card spinning containing 60 to 90 % by weight $Ce_{8-22}$ fatty acid methyl esters, 5 to 39.95% by weight emulsifiers and 0.05 to 10 % by weight homopolymers and/or copolymers of esters of acrylic and/or methacrylic acid having limiting viscosities [eta] below 400 $ml \cdot g^{-1}$, as measured in tetrahydrofuran at 20° C., and 0 to 10% by weight additives.

The key monomer units of the polymer compounds intended as viscosity enhancers are selected esters of acrylic and/or methacrylic acid—hereinafter referred to simply as (meth)acrylates. The alcohol component of these (meth)acrylates is derived from linear and/or branched monofunctional alcohols containing 4 to 18 carbon atoms, those containing from 6 to 12 carbon atoms, such as n-butyl (meth)acrylate, n-hexyl (meth)acrylate, n-decyl (meth)acrylate and/or 2-ethylhexyl (meth)acrylate, being particularly preferred. The polymer compounds may be homopolymers and/or copolymers of the type mentioned, the copolymers having to be notionally divided into two classes. In the first class, various (meth)acrylates corresponding to the above definition are copolymerized with one another and thus form a copolymer. In the second class, copolymers are those containing polymerizable comonomers which are not (meth)acrylates. In the last case, at most substantially equal quantities of the comonomers are present in the polymer molecule. In this case, the comonomer content is best at most 35% by weight and, preferably, no more than 25% by weight, based on the monomer mixture. Comparatively small quantities—5 to 10% by weight—of the comonomers in the polymer molecule can be particularly appropriate. Suitable comonomers of the last-mentioned type are, for example, styrene and styrene derivatives, such as alkyl styrenes, (meth)acrylates of monofunctional alcohols containing less than 4 carbon atoms, acrylonitrile, vinyl esters of aliphatic carboxylic acids, such as vinyl acetate, and/or vinyl esters of higher aliphatic carboxylic acids containing up to 18 carbon atoms, free methacrylic acid or acrylic acid, (meth)acrylic amide or even other typical comonomers. Particularly suitable polymers are selected from copolymers of (meth)acrylates derived from $C_{6-12}$ alcohols and (meth)acrylic acid, the copolymers preferably having been produced in a ratio by weight of (meth)acrylate to (meth)acrylic acid of 85:15 to 98.5:1.5, or copolymers of (meth)acrylate derived from $C_{6-12}$ alcohols and styrene and (meth)acrylic acid, the copolymers preferably having been produced in a ratio by weight of (meth)acrylate to (meth)acrylic acid of 85:15 to 98.5:1.5 and 2 to 25% by weight of the (meth-)acrylates having been replaced by styrene.

The polymer compounds are prepared in particular by emulsion polymerization in an aqueous medium. Preferred polymerization temperatures are in the range from 70° to 90° C.

The water phase used for the aqueous emulsion polymerization preferably contains surface-active compounds, more particularly anionic surfactants, to promote the solubility in water of the monomer compounds which, basically, are substantially insoluble in water. The quantity in which these surfactants are used may make up, for example, as much as 15% by weight, based on the monomer or monomer mixture used, and is best in the range from about 1 to 15% by weight and, more particularly, in the range from about 3 to 10% by weight, based on the weight of the monomer. The surface-active compounds may be used in their entirety from the outset although, if desired, they may also be added to the aqueous medium during the reaction. Suitable anionic surfactants belong, for example, to the classes of alkyl and aryl sulfonates, alkyl and aryl sulfates and ether sulfates. Suitable examples are fatty alcohol sulfates, such as sodium lauryl sulfate, or corresponding fatty alcohol ether sulfates, such as the sodium salt of a $C_{12/14}$ fatty alcohol ·4 EO sulfate. Other suitable anionic emulsifiers are alkyl benzene sulfonates, alkyl phenol sulfates and alkyl phenol ether sulfates. An important class of emulsifiers are sulfosuccinic acid derivatives, for example dialkyl sulfosuccinates or sulfosuccinates of alkoxylated, more particularly ethoxylated, alkanols, more particularly fatty alcohols.

It is important that the reactants and the reaction system are kept adequately free from oxygen. This requirement is satisfied in known manner by purging with an inert gas or by carrying out the polymerization reaction in an inert gas atmosphere. Suitable polymerization catalysts are, for example, ammonium persulfate or potassium persulfate. Preferred quantities of the catalyst are in the range from about 0.05 to 0.8% by weight and, more particularly, in the range from about 0.1 to 0.3% by weight, based on the monomers used.

In the process of aqueous emulsion polymerization, the polymers accumulate directly in the form of an aqueous emulsion and may be used as such in the lubricant. The quantities of polymer are always based on the active substance content of polymer in the emulsion unless otherwise stated.

The limiting viscosity of the (meth)acrylate homopolymers or copolymers must not be too high for the intended application because otherwise yarn tension would be created and the polymers could no longer be emulsified in water. The maximum limiting viscosity is 400, preferably 300 and, more preferably, 250 ml $g^{-1}$, as measured in tetrahydrofuran at 20° C. On the other hand, the limiting viscosity [eta] should be above 50 and, more particularly, above 150 ml $g^{-1}$, as measured by the above method, to ensure that an increase in viscosity is noticeable in the relatively small quantities mentioned.

The limiting viscosity numbers [eta] mentioned in the foregoing are standard values, cf. Vollmert "Grundriß der makromolekularen Chemie" Vol III, pages 55–61, Karlsruhe 1982.

The lubricants according to the invention are produced in known manner by mixing the constituents mentioned with one another in any order in the quantities mentioned at the temperatures in the range from 18° to 25° C. The polymers are used in the form of aqueous emulsions, generally in the form of 10 to 40% by weight emulsions of active substance.

The present invention also relates to a process for lubricating textile fibers for the production of carded yarns, characterized in that the textile fibers are treated with an aqueous emulsion which has an active substance content, based on the weight of the fibers, of 1 to 6% by weight and preferably 2 to 4% by weight lubricant.

The aqueous emulsion is applied to the textile fibers, preferably by spraying, at temperatures of 18° to 25° C. It is particularly favorable to allow the emulsion to act on the fibers for 6 to 10 hours before the fibers are combed and spun. Particulars of the treatment of fibers for the production of carded yarns can be found in the Article entitled "Neue Aspekte des Avivierens in der Streichgarn-spinnerei (New Aspects of Finishing in Card Spinning)" by Dr. Veitenhans et al. in "Textil Praxis International", August 1984, pages 748 to 758.

The aqueous emulsion is prepared in known manner by mixing the lubricant based on fatty acid methyl esters with water at temperatures of 18° to 25° C.

Suitable textile fibers are textile fibers of natural and/or synthetic origin, for example wool, polyester or wool/polyester blends. The optionally dyed textile fibers are present in the form of flocks.

A lubricant based on fatty acid methyl esters has excellent spreading power on textile fibers. During the production of carded yarn, more particularly during combing and spinning, fiber/fiber friction and fiber/metal friction are both optimal. The carded yarns produced show high tensile strength and good uniformity.

EXAMPLES

Determination of spreading power 2 g

A) tallow fatty acid methyl ester

B) lubricant of 73.4% by weight tallow fatty acid methyl ester 4.2% by weight $C_{12/14}$ fatty alcohol · 5 mol ethylene oxide 2.5% by weight $C_{12/14}$ fatty alcohol · 2 mol ethylene oxide 3.4% by weight coconut oil fatty acid diethanolamide 5.8% by weight oleic acid · 25 mol ethylene oxide 5.8% by weight phosphoric acid ester of 2-ethyl hexanol · 2 mol ethylene oxide, potassium salt 0.4% by weight 40% by weight potassium hydroxide 0.4% by weight preservative (Mergal K11; Riedel de (Häen) and 4.1% by weight water Ubbelohde viscosit (DGF C-IV-7) at 25° C. $=6$ $mm^2s^{-1}$ C) lubricant corresponding to B), but with only 70.9% by weight tallow fatty acid methyl ester and, in addition, 2.5% by weight of a 30% by weight aqueous emulsion of a polyester of 80% by weight ethyl hexyl acrylate, 15% by weight styrene and 5% by weight methacrylic acid (=polymer 1 in Table III)

Ubbelohde viscosity (DGF C-IV-7) at 25° C. $=50$ $mm^2s^{-1}$

D) stearic acid isobutyl ester

E) stearic acid-2-ethylhexyl ester dyed with an oil-soluble dye (Sudannot 7 B) were applied to undyed wool cloth (230 g/m) extracted with ethanol/petroleum ether.

The spreading power of the fatty acid ester on the wool cloth was then determined in a standard conditioning atmosphere (20° C./65% relative humidity). The diameter of the area wetted after a certain time was used as a measure of spreading power. The results are set out in Table I below (the larger the wetted area, the better the spreading power).

TABLE I

| | Spreading power Diameter in $mm^2$ of the wetted area after | | |
|---|---|---|---|
| Example | 1 minute | 3 minutes | 5 minutes |
| A | 38 | 50 | 56 |
| B | 35 | 48 | 55 |
| C | 35 | 45 | 53 |
| D | 32 | 40 | 43 |
| E | 28 | 40 | 43 |

It can be seen from Table I that the pure methyl ester (A), the lubricant containing only methyl ester (B) and the polymer-thickened lubricant (C) have better spreading power than the fatty acid esters with other alcohols (D,E) known from the prior art.

Application Example 20 kg of a lubricant of composition C in the form of an aqueous emulsion (20 kg lubricant in 80 kg water) was applied by spraying to 500 kg dyed, dried, unfinished wool flock.

After a contact time of 7 hours, the wool flock was processed in known manner to carded yarn (count 7).

For comparison, wool flock was treated under the same conditions with a lubricant which contained 73.4% by weight stearic acid isobutyl ester or 73.4% by weight stearic acid 2-ethylhexyl ester instead of 70.9% by weight tallow fatty acid methyl ester and 2.5 g polymer emulsion.

The electrostatic charging of the treated wool flock was measured with an Eltex field strength meter by the induction current method (measuring distance 100 mm) at the exit of the carding machine.

The tensile strength (cN/tex) and elongation (%) of the yarns were measured with a Textechno Statimat M in a standard conditioning atmosphere (20° C./65% relative humidity).

The irregularity of the carded yarn was measured with an Uster Tester III (Zellweger-Uster) in a standard conditioning atmosphere (20° C./65% relative humidity).

The results are set out in Table II.

TABLE II

| Lubricant containing as fatty acid ester | Electrostatic charging KV/m | Yarn tensile strength cN/tex | Elongation % | Yarn irregularity % |
|---|---|---|---|---|
| Tallow acid methyl ester | −5 | 0.46 | 16.3 | 12.5 |
| For comparison: | | | | |
| Stearic acid isobutyl ester | −4 | 0.38 | 17.0 | 13.0 |
| Stearic acid 2−ethylhexyl ester | −5 | 0.40 | 14.8 | 14.2 |

The following polymers (see Table III) may be used instead of the polymer used in lubricant C. They impart spreading power and give comparable results in the performance test. The polymers were prepared by introducing 690 g demineralized water, 10 g diethyl hexyl sulfosuccinate sodium salt (75% aqueous solution) and 0.2 g ammonium peroxodisulfate into a three-necked flask equipped with a stirrer, reflux condenser and dropping funnel and heating to 80° C. 300 g of the monomer mixture shown in Table III were then added, followed by stirring for 1 hour at 80° C. Fine-particle aqueous polymer emulsions were obtained.

The limiting viscosities of the polymers were measured in tetrahydrofuran at 20° C.

TABLE III

| | Polymers and limiting viscosity [eta] | |
|---|---|---|
| | Composition in % by weight | Limiting viscosity in THF at 20° C. |
| 1 | 80 ethylhexyl acrylate<br>15 styrene<br>5 methacrylic acid | 180 |
| 2 | 90 n-butyl acrylate<br>10 methacrylic acid | 350 |
| 3 | 97.5 ethylhexyl methacrylate<br>2.5 methacrylic acid | 240 |
| 4 | 65 ethylhexyl methacrylate<br>30 n-decyl methacrylate<br>5 methacrylic acid | 200 |
| 5 | 40 ethylhexyl acrylate<br>50 n-butyl acrylate<br>10 acrylic acid | 170 |

We claim:

1. The process of lubricating textile fibers in the production of carded yarns, comprising contacting said textile fibers with a lubricant composition consisting essentially of a smoothing agent consisting of from 60 to 90% by weight of a $C_8$–$C_{22}$ fatty acid methyl ester in admixture with 0.05 to 10% by weight of a viscosity-enhancing homopolymer or copolymer of an ester of acrylic acid or methacrylic acid having a limiting viscosity below 400 ml $g^{-1}$ as measured in tetrahydrofuran at 20° C., based on the weight of said lubricant composition.

2. A process as in claim 1 wherein said methyl ester comprises a saturated or unsaturated $C_{12}$–$C_{22}$ fatty acid methyl ester.

3. A process as in claim 1 wherein said textile fibers are contacted with an aqueous emulsion of said lubricant composition containing 1 to 6% by weight of said composition on an active content basis, based on the weight of said textile fibers, said lubricant composition consisting essentially of 60 to 90% by weight of said fatty acid methyl ester, 5 to 39.95% by weight emulsifier, 0.05 to 10% by weight of said viscosity-enhancing homopolymer or copolymer, and 0 to 10% by weight of conventional lubricant composition additives, based on the weight of said lubricant composition.

4. A process as in claim 1 wherein an alcohol component of said viscosity-enhancing homopolymer or copolymer is selected from straight-chain or branched monofunctional alcohols containing 4 to 18 carbon atoms.

5. A process as in claim 1 wherein said viscosity-enhancing copolymer contains up to 35% by weight of a polymerizable comonomer.

6. A process as in claim 1 wherein an alcohol component of said viscosity-enhancing copolymer contains 6

7. A process as in claim 1 wherein said viscosity-enhancing homopolymer or copolymer has a limiting viscosity above 150 ml $g^{-1}$ and below 300 ml $g^{-1}$, as measured in tetrahydrofuran at 20° C.

8. A process as in claim 3 including spraying said aqueous emulsion onto said textile fibers.

9. A lubricant composition for lubricating textile fibers in the production of carded yarns, said lubricant composition consisting essentially of a smoothing agent consisting of from 60 to 90% by weight of a $C_8$–$C_{22}$ fatty acid methyl ester in admixture with 0.05 to 10% by weight of a viscosity-enhancing homopolymer or copolymer of an ester of acrylic acid or methacrylic acid having a limiting viscosity below 400 ml $g^{-1}$ as measured in tetrahydrofuran at 20° C., based on the weight of said lubricant composition.

10. A lubricant composition as in claim 9 wherein said methyl ester comprises a saturated or unsaturated $C_{12}$–$C_{22}$ fatty acid methyl ester.

11. A lubricant composition as in claim 9 in the form of an aqueous emulsion containing 1 to 6% by weight of said composition on an active content basis, based on the weight of said lubricant composition, said lubricant composition consisting essentially of 60 to 90% by weight of said fatty acid methyl ester, 5 to 39.95% by weight emulsifier, 0.05 to 10% by weight of said viscosity-enhancing homopolymer or copolymer, and 0 to 10% by weight of conventional lubricant composition additives, based on the weight of said lubricant composition.

12. A lubricant composition as in claim 9 wherein an alcohol component of said viscosity-enhancing homopolymer or copolymer is selected from straight-chain or branched monofunctional alcohols containing 4 to 18 carbon atoms.

13. A lubricant composition as in claim 9 wherein said viscosity-enhancing copolymer contains up to 35% by weight of a polymerizable comonomer.

14. A lubricant composition as in claim 9 wherein an alcohol component of said viscosity-enhancing copolymer contains 6 to 12 carbon atoms.

15. A lubricant composition as in claim 9 wherein said viscosity-enhancing homopolymer or copolymer has a limiting viscosity above 150 ml $g^{-1}$ and below 300 ml $g^{-1}$ as measured in tetrahydrofuran at 20° C.

* * * * *